United States Patent [19]

Ise

[11] 4,432,701

[45] Feb. 21, 1984

[54] VACUUM CONTROLLING DEVICE

[76] Inventor: Yoji Ise, c/o Kabushiki Kaisha Myotoku Seisakusho, 6-18,Shimomaruko 2-Chome, Ota-Ku, Tokyo, Japan

[21] Appl. No.: 251,747

[22] Filed: Apr. 7, 1981

[51] Int. Cl.[3] ..... F04F 5/48

[52] U.S. Cl. ..... 417/187; 294/64 A

[58] Field of Search ..... 248/362; 294/64 A, 64 B; 417/187, 188, 189

[56] References Cited

U.S. PATENT DOCUMENTS

| | | | |
|---|---|---|---|
| 1,441,651 | 1/1923 | Anderson | 417/189 |
| 2,124,620 | 7/1938 | Kirgan | 417/189 |
| 2,874,989 | 2/1959 | Reynolds | 417/187 |
| 3,285,181 | 11/1966 | Howard | 417/38 |
| 3,612,722 | 12/1971 | Neward | 417/63 |
| 3,716,307 | 2/1973 | Hansen | 417/191 |
| 3,967,849 | 7/1976 | Cagle | 417/184 |
| 4,290,446 | 9/1981 | Seiler | 417/63 |
| 4,309,149 | 1/1982 | McCombs | 417/63 |

*Primary Examiner*—Edward K. Look
*Assistant Examiner*—Jane E. Obee
*Attorney, Agent, or Firm*—Murray Schaffer

[57] ABSTRACT

The present invention relates to a vacuum controlling device wherein a vacuum can be obtained by jetting compressed air, a predetermined vacuum state can be automatically confirmed and further the vacuum state can be quickly released by switching compressed air.

2 Claims, 20 Drawing Figures

VACUUM CONTROLLING DEVICE

This invention relates to a vacuum controlling device to be used to convey or hold any article by vacuumizing the interior of a suction pad by obtaining a vacuum by means of an ejector pump utilizing compressed air from a compressor provided in any factory without using a large costly vacuum pump.

In various automating apparatus, there are already provided various devices for conveying or holding articles by pushing a suction pad against an article having a flat smooth surface and vacuumizing the interior of the suction pad to suck the article. However, the already provided vacuum pumps have defects that they are large and costly.

Further, in conveying or holding various articles by means of the above mentioned suction pad, if the conveying or holding device is operated without confirming the perfect suction or, in other words, the perfect vacuum within the suction pad, there will be a danger of dropping the article.

According to the present invention, a mechanism of confirming the above mentioned perfect suction is provided for the safety, the confirming signal is an electric signal and therefore can be simply utilized as a signal for starting the conveying or holding device and it is easy to make an automating apparatus.

Further, according to the present invention, the above mentioned suction of various articles can be quickly released. That is to say, the suction can be released even by only making a suction path communicate in a proper position with the atmosphere. However, in such case, it will take a time until the suction is released. Therefore, in the present invention, in releasing the suction, compressed air is positively fed into the suction pad from the compressor so that the suction can be released quickly and perfectly.

The above mentioned features and other advantages of the present invention will become apparent from the following detailed explanations relating to the embodiments shown in the accompanying drawings in which:

FIG. 1 is a front elevation view of the device of the present invention;

FIG. 2 is a rear elevation view of the device shown in FIG. 1;

FIG. 3 is a top plan view of the device shown in FIG. 1;

FIG. 4 is a bottom plan view of the device shown in in FIG. 1;

FIG. 5 is a right side view of the device of FIG. 1;

FIG. 7 is a top plan view of the device shown in FIG. 6;

FIG. 8 is a bottom plan view of the device shown in FIG. 6;

FIG. 9 is a left side elevational view, showing the hidden parts by one-dot chain lines;

FIG. 10 is a right side elevation view, showing the hidden parts by one-dot chain lines;

FIG. 11 is a sectional view taken along lines E—E in FIG. 6;

FIG. 12 is a vertical sectional view of the device;

FIG. 13 is a top plan view of the device of FIG. 2;

FIG. 14 is a sectional view taken on line F—F in FIG. 12;

FIG. 15 is a sectional view taken on line G—G in FIG. 12;

FIG. 16 is a sectional view taken on line H—H in FIG. 12;

FIG. 17 is a vertically sectioned view thereof;

FIG. 18 is a top plan view of the vacuum confining switch;

FIG. 19 is a sectional view taken on line I—I in FIG. 17;

FIG. 20 is a sectional view taken on line J—J in FIG. 17;

Figure 1:
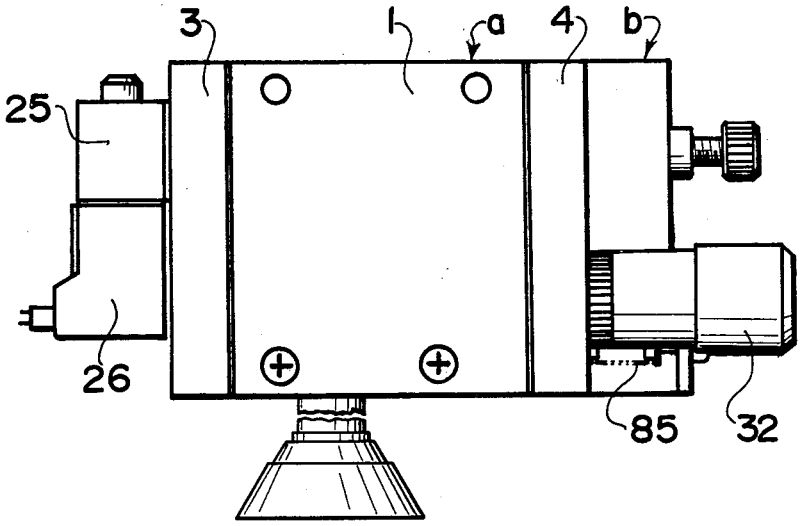
FIGS. 1 to 5 show general views of a device of the present invention.
Figure 5:
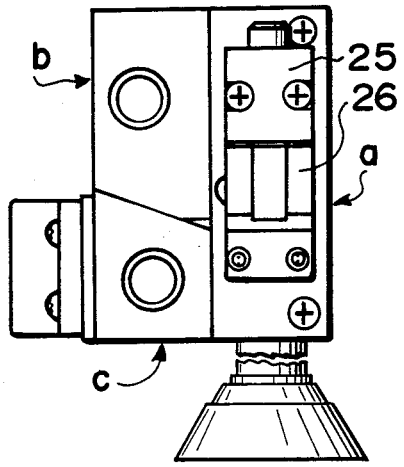
Figure 2:
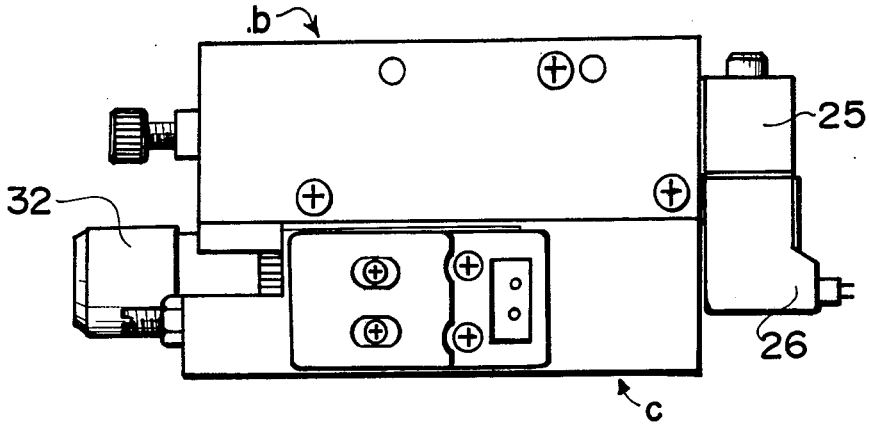
Figure 3:
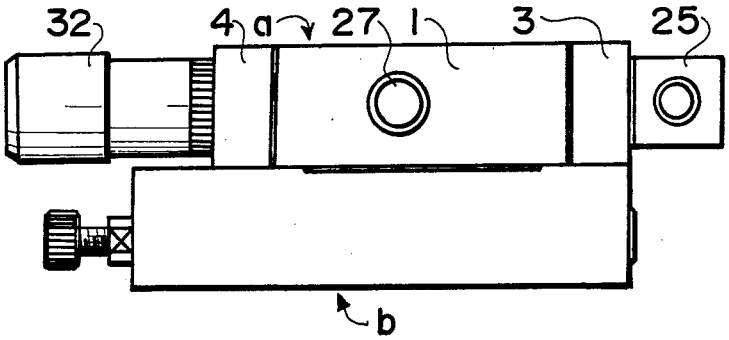
Figure 4:
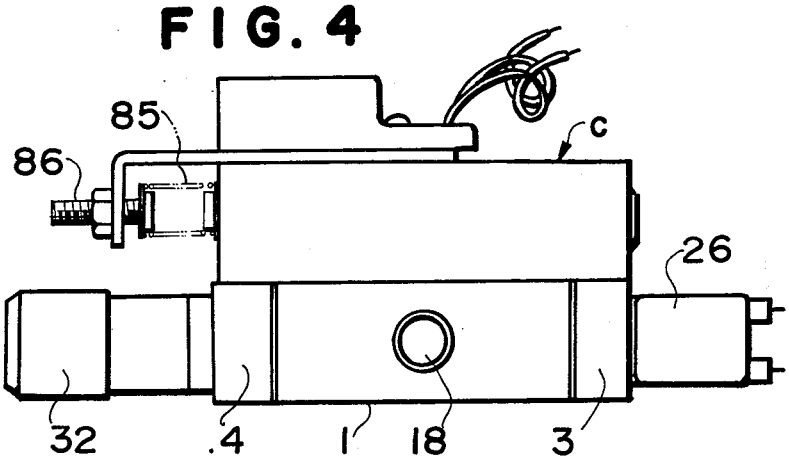

In the present invention, a vacuum source body a, vacuum releasing valve b and vacuum confirming switch c are integrally formed. Further, a compressed air switching controlling mechanism and ejector pump are contained within the vacuum source body a.

The vacuum source body a is shown in FIGS. 6 to 11. That is to say, the vacuum source body a is formed of a body 1 and side plates 3 and 4 removably fitted to both sides of the body 1 with screws 2 and 2*a*. First of all, the body 1 is provided within it with a compressed air feeding path 5 extending in the lateral direction; a lateral hole 8 fitted with sleeves 6*a*, 6*b* and 6*c* and a spool 7; a path 9 provided in the lateral direction, and; a lateral hole 12 fitted with a nozzle body 10 forming an ejector pump and conical body 11. The body 1 is further provided with a vertical communicating hole 13; making the lateral hole 8 communicate with the feeding path 5; a communicating hole 14 making the path 9 communicate with the lateral hole 8, and; a through hole 18 for connecting a suction hose to a partition chamber X formed between the nozzle body 10 and conical hole body 11.

According to the present invention, the feeding path 5, lateral hole 8, path 9 and lateral hole 12 of the above mentioned body 1 can be simply formed by boring from the fitting surface sides of the side plates 3 and 4. The communicating hole 14 is formed by boring in the vertical direction from the upper surface in FIG. 6 and fitting a plug 19 therein.

Further, the side plate 3 is provided with a through hole 23 fitting the above mentioned compressed air feeding path 5, a through hole 24 fitting the lateral hole 8 fitted with the sleeves 6*a*, 6*b* and 6*c* and spool 7 and a communicating groove 16 making the nozzle body 10 communicate with the path 9. A three-way switching valve 25 and a solenoid 26 driving it are provided on the outside surface of the through holes 23 and 24. In the drawing, 27 is a compressed air feeding port.

Further, the side plate 4 is provided with a through hole 28 making the compressed air feeding path 5 communicate with the lateral hole 8, a recessed hole 30 receiving a spring 29 provided at one end of the spool 7 and a compressed air exhausting port 31. A silencing muffler 32 is fitted to the exhaust port 31 part.

In the drawing, 33 and 34 are sleeve pressing rings, 35 is an O-ring, 36 is a seal ring, 37 is a seal packing, 39 is a piston formed on the spool 7 and 40 is a fitting hole.

Figure 6:
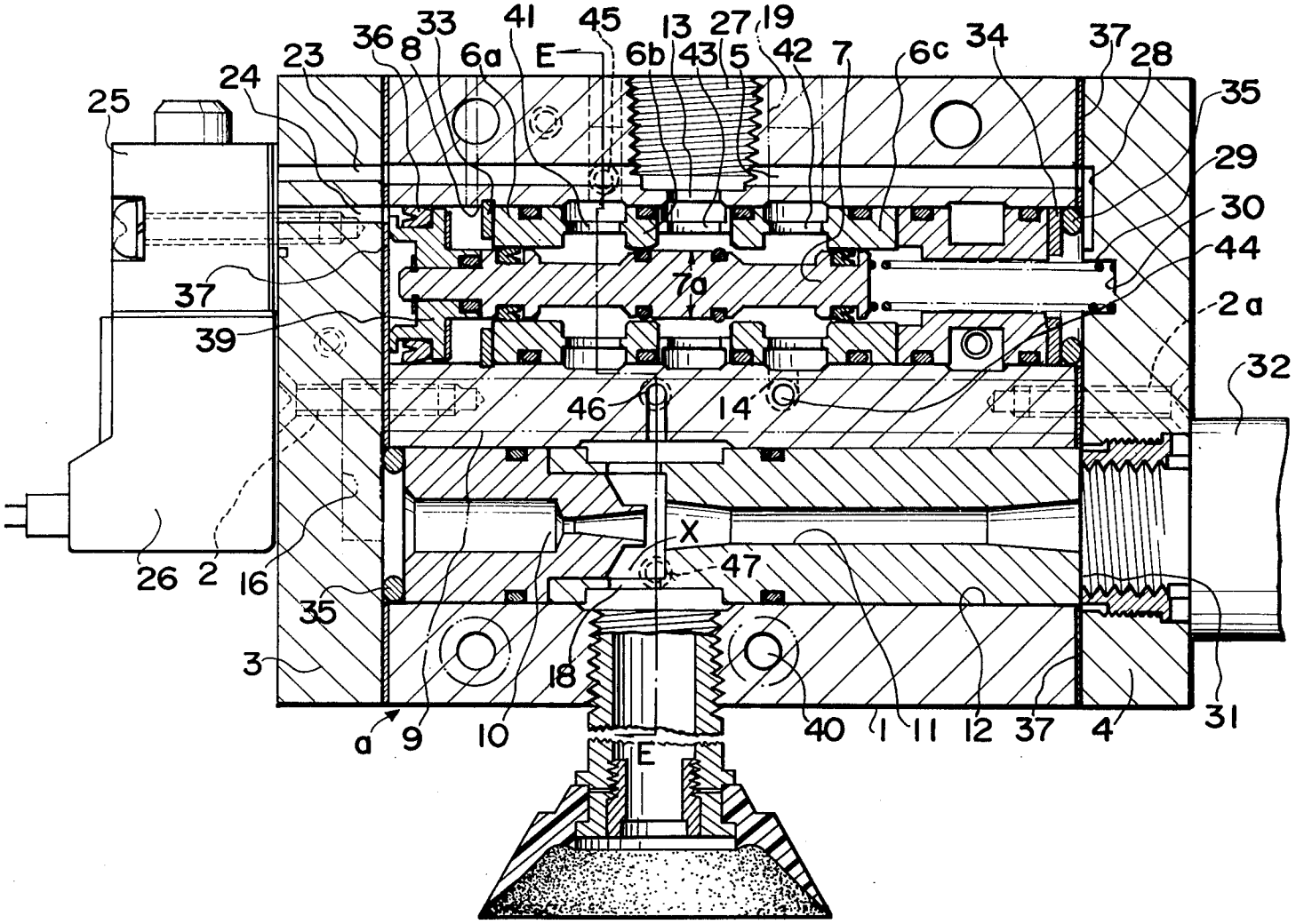
FIGS. 6 to 11 show in detail the vacuum source body of FIG. 1.
Figure 7:
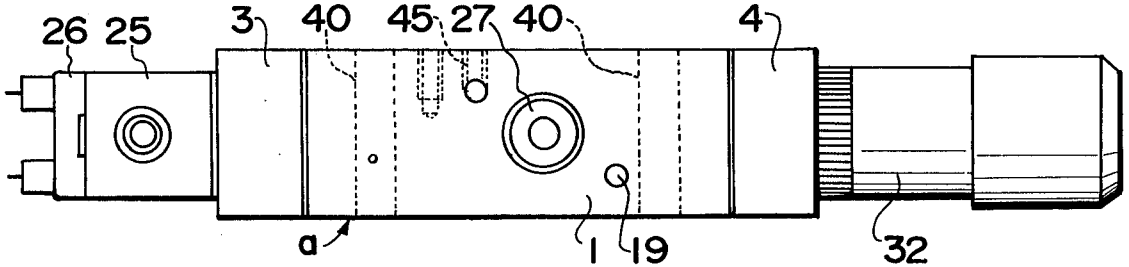
Figure 8:
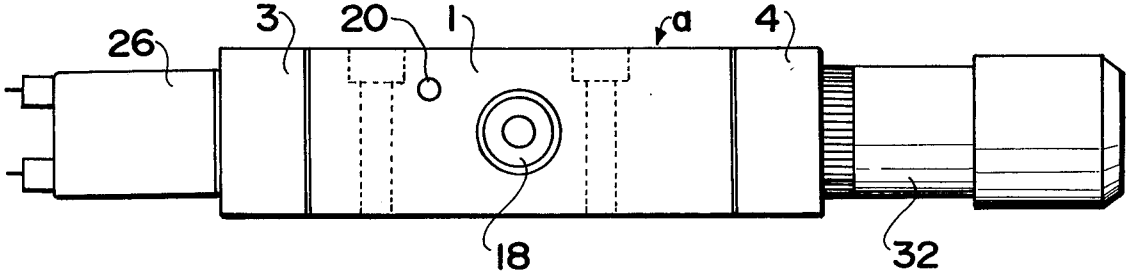
Figure 9:
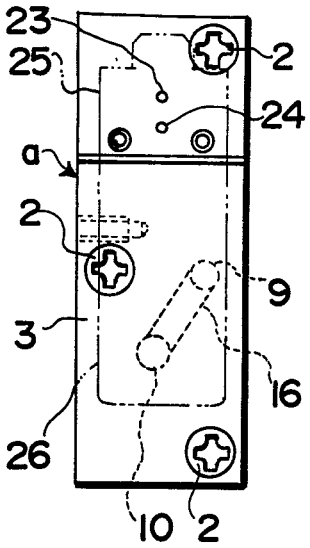
Figure 10:
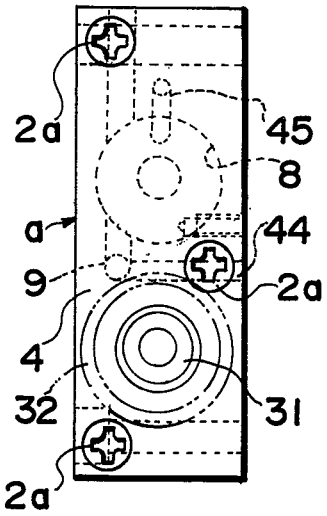
Figure 11:
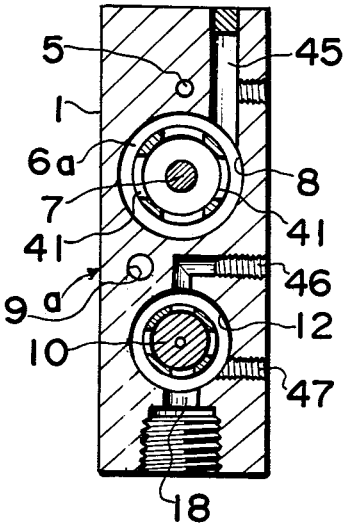

The sleeves 6*a*, 6*b* and 6*c* and spool 7 of the present invention shall be described in the following. The sleeve body may be integral but is divided into three sleeves as shown in FIG. 6. The sleeves 6*a* and 6*c* are formed to be of the same shape and are provided respectively with communicating holes 41 and 42. The sleeve 6b is provided with a communicating hole 43.

The spool 7 is set within the above mentioned sleeves 6a, 6b and 6c, has a thick part 7a formed substantially in the middle and is so formed as to seal on one side the inner end of the sleeve 6a or 6c.

In the above mentioned vacuum source body a suction hose and suction pad are connected in turn to the through hole 18. An example of the vacuum action shall be explained. In the case of the illustration in FIG. 6, the through holes 23 and 24 provided in the side plate 3 are closed by the three-way switching valve 25 and the spool 7 is biased leftward by the spring 29 and, when compressed air is fed into the feeding port 27, it will pass through the feeding path 5, communicating hole 13 and communicating hole 43 of the sleeve 6b, around the periphery of the spool 7, through the communicating hole 42 of the sleeve 6c, communicating hole 14, path 9 and communicating groove 16 and will be jetted toward the conical hole body 11 out of the nozzle body 10, a negative pressure will be made within the partition chamber X, air in the suction hose and suction pad connected to the through hole 18 will be sucked and exhausted and the work will be sucked by the suction pad and will be able to be moved or fixed. By the way, in the drawing, 44 is a communicating hole making the above mentioned path 9 communicate with a later described vacuum releasing valve b, 45 is a communicating hole making the lateral hole 8 in the position of the sleeve 6a communicate also with the later described vacuum releasing valve b, 46 is a communicating hole making the later described vacuum releasing valve b communicate with the partition chamber X and 47 is a communicating hole communicating with a later described vacuum confirming switch c.

The vacuum releasing valve b shall be described in the following. The vacuum releasing valve b is formed as shown in FIGS. 12 to 16.

That is to say, a lateral hole 51 is made in a body 50, a partition wall 53 having a through hole 52 is fixed to one side of the lateral hole 51, a rod 54 is loosely inserted through the through hole 52, a piston 55 is fixed to the inside end of the rod 54, a piston 56 of a diameter smaller than the inside diameter of the lateral hole 51 is fixed to the outside end of the rod 54 and the lateral hole 51 is closed at one end with a plug 57. Further, a sleeve 58 and a partition wall 60 having a through hole 59 are provided on the other side of the lateral hole 51, a hollow spool 62 having a shaft 61 is provided as separated from the sleeve 58 between the sleeve 58 and partition wall 60, a spring 63 is interposed between the partition wall 60 and spool 62 and further a communicating hole 64 making the inside and outside communicate with each other is provided in the spool 62.

In the drawing, 65 is a communicating groove communicating with the communicating hole 44 of the switching path 9 of the above mentioned vacuum source body a, made to communicate with an annular groove 66 provided in a proper position on the outer periphery of the sleeve 58 and connected to the back surface of the spool 62 through a communicating hole 67 provided in said annular groove 66 part.

Also, in the drawing, 68 is a communicating groove communicating with the communicating hole 45 provided in the position of the sleeve 6a in the lateral hole 8 of the above mentioned vacuum source body a and opened between the pistons 55 and 56 in the lateral hole 51.

Further, in the drawing, 69 is a communicating groove making the partition wall 53 part in the lateral hole 51 communicate with the through hole 46 communicating with the partition chamber X of the above mentioned vacuum source body a. An annular groove 70 provided in a proper position on the outer periphery of the partition wall 53 is made to communicate with the rod 54 part within the partition wall 53 through a communicating hole 71.

The case of releasing the suction of the work sucked by the suction pad shall be described in the following. First of all, while the above mentioned vacuum source body a is working, a part of compressed air will pass through the path 9, communicating hole 44, communicating groove 65 of the vacuum releasing valve b, annular groove 66 of the sleeve 58, communicating hole 67, communicating hole 64 of the spool 62 and through hole 59 of the partition wall 60 and will push the piston 55 and rod 54 and piston 56 will be in such positions as are shown in FIG. 12.

When an electric current is then passed through the solenoid 26 of the vacuum source body a, the three-way switching valve 25 will be switched, compressed air will pass through the feeding port 27, feeding path 5, through hole 23 and through hole 24, will be fed to the back surface of the piston 39 of the spool 7, the spool 7 will be moved rightward in FIG. 6 and the thick part 7a of the spool 7 will separate from the inner end of the sleeve 6a and will seal the inner end of the sleeve 6c.

Figure 12:
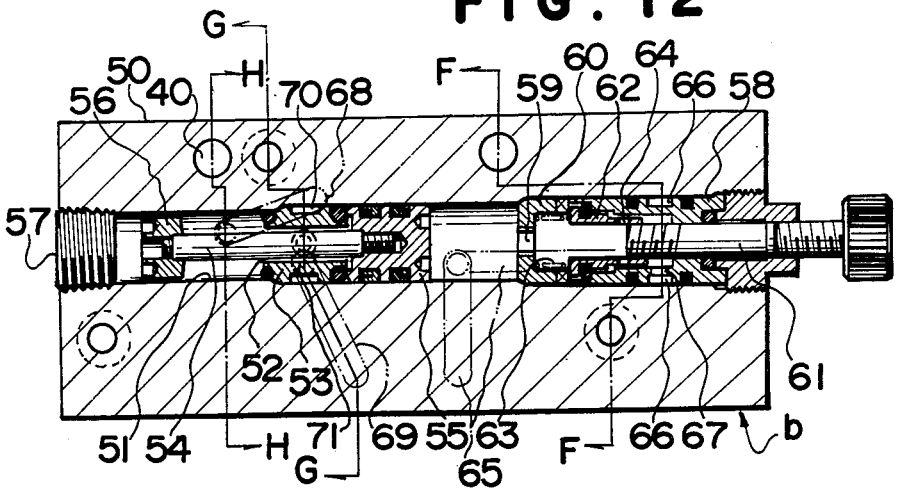
FIGS. 12 to 16 show in detail the vacuum releasing valve shown in FIG. 1.
Figure 13:
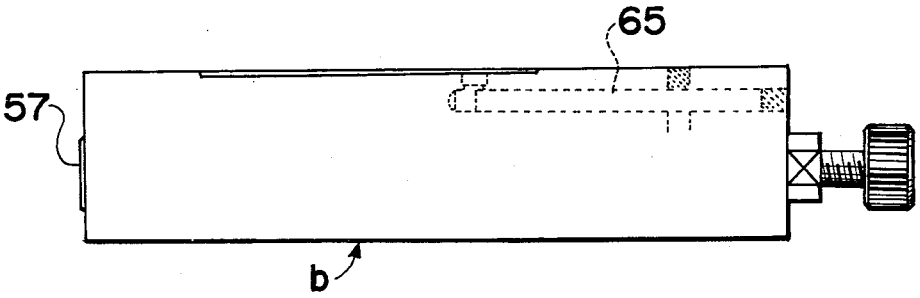
Figure 14:
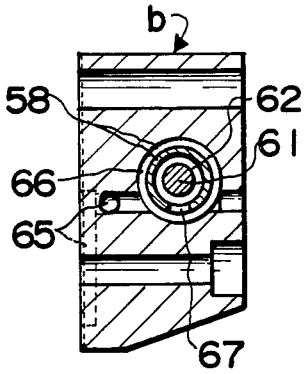
Figure 15:
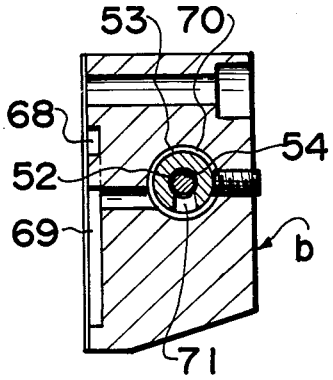
Figure 16:
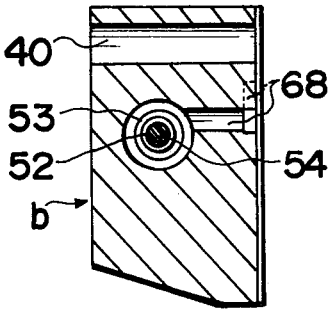
Figure 19:
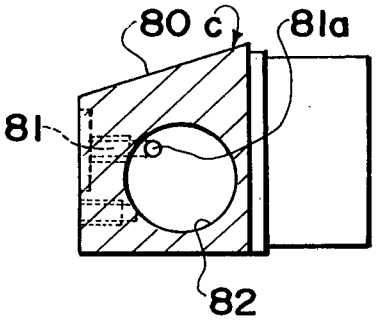
FIGS. 17 to 20 show a vacuum confirming switch.
Figure 20:
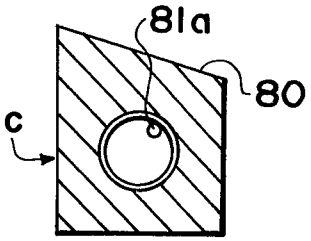
Figure 17:
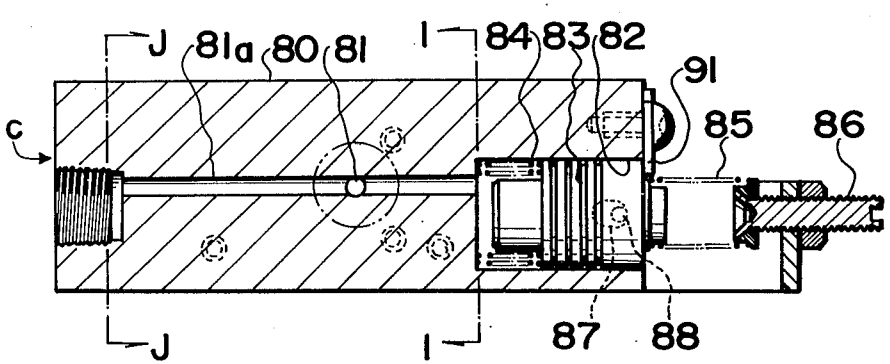
Figure 18:
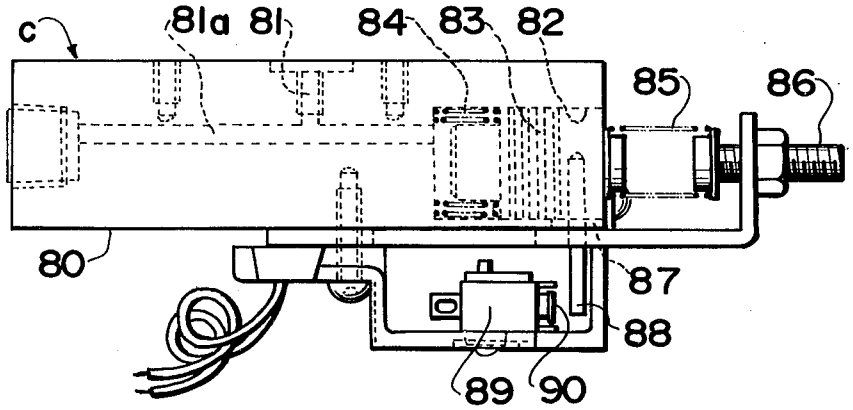

As a result, compressed air will pass through the feeding port 27, feeding path 5, communicating hole 13 and communicating hole 43 of the sleeve 6b, around the periphery of the spool 7 and through the communicating hole 41 of the sleeve 6a, communicating hole 45 and communicating groove 68 of the vacuum releasing valve b and will be fed between the pistons 55 and 56 within the lateral hole 51 and, as there is a clearance between the piston 56 and lateral hole 51, the piston 55 will be gradually moved rightward in the state shown in FIG. 12 and the rod 54 and piston 56 will be also moved in the same manner until the piston 56 is sealed with the partition wall 53.

Meanwhile, that is, until the piston 56 is sealed with the partition wall 53, the fed compressed air will pass between the partition wall 53 and rod 54 and through the communicating hole 71, annular groove 70, communicating groove 69 and through hole 46 of the vacuum source body a, will enter the partition chamber X, will be fed to the suction hose and suction pad not illustrated connected to the through hole 18 and the suction will be quickly released.

The vacuum confirming switch c shall be described in the following. As in FIGS. 17 to 20, a communicating hole 81 communicating with the communicating hole 47 provided in the partition chamber X part of the vacuum source body a is provided in a proper position in a body 80, further another cylinder 82 and piston 83 are provided, a spring 84 is fitted within the cylinder about the end of the piston 83 and further the above mentioned communicating hole 81 is made to communicate with a through hole 81a. Further, a stopper 91 is provided outside the piston 83 so as to prevent the piston 83 from dropping off and a spring 85 for adjusting the piston 83 and an adjusting screw 86 are also provided.

Further, a slot 87 extends through the outside surface of the body 80 into the cylinder 82 and a pin 88 radially projects from the outside surface of the piston 83 into the slot 87.

Then, a microswitch 89 is provided in a position opposed to the above mentioned pin 88 on the outside surface of the body 80 so that a movable contact 90 of the microswitch 89 will be pushed when the pin 88 is moved by the piston 83.

In the vacuum confirming switch c of the above mentioned formation, when the vacuum source body a is worked and a negative pressure is made in the partition chamber X, the communicating hole 47 of the vacuum source body a, communicating hole 81 of the vaccum confirming switch c, through hole 81*a* and interior of the cylinder 82 will be under the negative pressure, the piston 83 will move and the pin 88 provided in the piston 83 will connect the microswitch 89. By this electric signal, the device for moving the suction pad may be operated.

In the present invention, the above mentioned vacuum source body a, vacuum releasing valve b and vacuum confirming switch c are integrally formed as shown in FIGS. 1 to 5. That is to say, the vacuum releasing valve b and vacuum confirming switch c are fitted to one side surface of the vacuum source body a and it is designed in advance that the communicating hole 44 of the vacuum source body a fits the communicating groove 65 of the vacuum releasing valve b, the communicating hole 45 of the vacuum source body a fits the communicating groove 68 of the vacuum releasing valve b, the communicating hole 46 of the vaccum source body a fits the communicating groove 69 of the vacuum releasing valve b and the communicating hole 47 of the vacuum source body a fits the communicating hole 81 of the vacuum confirming switch c.

As mentioned above, in the present invention, the vacuum releasing valve and vacuum confirming switch are provided in addition to the vacuum source body so that the vacuum within the suction pad can be quickly released by the vacuum releasing valve and the vacuum state within the suction pad can be automatically confirmed by the vacuum confirming switch.

What I claim is:

1. A vacuum control device comprising a body having an inlet port adapted for connection to a source of air under pressure and an outlet port for connection to a suction pad, a movable spool mechanism receiving air from said inlet port, an air jet ejector having a nozzle and an aspirator chamber in communication with said outlet port, said spool mechanism having a first position permitting said air under pressure to flow to said nozzle thereby forming a vacuum in said aspirator chamber, and a second position blocking the flow of air under pressure to said aspirator chamber, and a vacuum release valve receiving air under pressure from said spool mechanism, said vacuum release valve being movable in response to the flow of air through said spool mechanism on movement of said spool mechanism into its second position to permit air under pressure to flow to the aspirator chamber and in response to the flow of air through said spool mechanism on movement of said spool mechanism into its first position to block flow of air under pressure to said aspirator chamber.

2. The device according to claim 1, including a vacuum confirming device, comprising a piston movable in a cylinder, said cylinder being in communication with said aspirator chamber, said piston being movable on establishment of a vacuum in said aspirator chamber to activate a microswitch.

* * * * *